United States Patent [19]

Cohen

[11] Patent Number: 4,593,421

[45] Date of Patent: Jun. 10, 1986

[54] TURBULENCE REDUCING GUTTER SYSTEM FOR SWIMMING POOLS

[76] Inventor: Ira M. Cohen, 412 Anthwyn Rd., Narberth, Pa. 19072

[21] Appl. No.: 706,494

[22] Filed: Feb. 28, 1985

[51] Int. Cl.[4] ..... E04H 3/20

[52] U.S. Cl. ..... 4/507; 4/510; 52/169.7; 210/169

[58] Field of Search ..... 52/169.7; 4/497, 510, 4/511, 512, 490, 506, 507, 492, 541-544; 210/169, 220

[56] References Cited

U.S. PATENT DOCUMENTS

| | | | |
|---|---|---|---|
| 2,932,397 | 4/1960 | Ogden | 4/510 |
| 3,432,867 | 3/1969 | Whitten, Jr. | 4/510 |
| 3,890,230 | 6/1975 | Patterson | 210/169 |
| 3,945,061 | 3/1976 | Whitten | 4/510 |
| 4,059,856 | 11/1977 | Patterson | 4/510 |
| 4,080,670 | 3/1978 | van den Broek | 4/510 |
| 4,380,837 | 4/1983 | Corna | 4/512 |
| 4,389,739 | 6/1983 | Baker | 4/512 |
| 4,494,257 | 1/1985 | Peirish | 4/512 |

*Primary Examiner*—Ernest G. Therkorn

*Attorney, Agent, or Firm*—Zachary T. Wobensmith, III

[57] ABSTRACT

A gutter system for reducing the turbulence of the water in a swimming pools is described of the overflow type, wherein obstacles to the flow of water are reduced for both water entering and leaving the gutter system.

7 Claims, 5 Drawing Figures

TURBULENCE REDUCING GUTTER SYSTEM FOR SWIMMING POOLS

BACKGROUND OF THE INVENTION

1. Field of the Invention

This invention relates to a recirculating gutter for swimming pools of the overflow type, and which provides for reduced water turbulence.

2. Description of the Prior Art

The use of overflow gutters for recirculating water from swimming pools has been known for many years. Typically such gutters include a gutter conduit with a front wall over the top of which dirty water flows, which provides for skimming the top surface of the pool water to a predetermined depth. The water overflowing the front wall typically flows through an open grate around the perimeter of the pool, and into the gutter conduit from which it flows by gravity into a converter and then into a tank from which it is removed by a pump, and passed through a filter or filters. The filtered clean water may pass through a heater, and then to a return water conduit or header pipe, which has nipples or other connections for returning the clean water to the pool. Examples of such systems are shown in the U.S. Pat. Nos. 2,932,397 to Ogden; 3,432,867 Whitten; and 4,080,670 Van den Broek. While such systems operate satisfactorily in their intended function of removing or skimming dirty water from a pool, filtering the water and returning the clean water to the pool, there are many applications where other considerations are present.

With the ever increasing popularity of swimming as a sport, and with improvements in swimming techniques, it has become apparent in pools used in competition such as the Olympics, that the skimming and return of clean water to such pools creates turbulence which has varied and noticeable effects on swimmers in the different lanes in the pool. In order to compensate for this turbulence, it has been necessary in many instances to shut off the filters during pool use, resulting in less than desirable sanitary conditions and violating various city and state health codes in effect for public swimming pools. Studies of the causes of turbulence have led to the conclusion that turbulence results from various obstacles to the smooth flow of water, both in the gutter conduit and in the clean water return system. The dirty water which overflows into the gutter, and is therefore "skimmed" from the pool water surface, faces a variety of obstacles in its journey around the gutter to the converter. There is no head or pressure in the gutter conduit water flow imposed by a pump. The flow is by gravity and the free surface has a distinct gradient. Then, efficient drainage is promoted by constructing a gutter channel with minimum resistance to the free flow of water, this will be achieved by placing elliptical shields described below around the injection nipples. The prior art nipples are often oriented so that the water flow into the pool is directed against the pool walls, which with the tremendous volume of water returned resulted in mineral deposits along the walls as well as a bounce back turbulent effect on the water. The prior art injection nipples often had a restriction at their exit into the pool, which resulted in noticeable turbulence at the water entry locations, and for a 75 foot by 175 foot pool, would have provided 125 such separate nozzles.

In terms that a swimmer would use, what is desired is a "fast pool" wherein the swimmer notices no turbulence, and therefore no interference with his swimming efforts, so that the lane position in which he or she swims does not affect performance. The gutter system of my invention provides such a "fast pool", as well as providing the health advantages obtained from an overflow recirculating gutter system.

SUMMARY OF THE INVENTION

This invention relates to a recirculating gutter system of the overflow type for skimming the dirty water from a pool surface into a gutter conduit, thence to a filter, and then returning the clean water through nozzles in the front portion of the gutter conduit, which gutter system extends around the perimeter of the pool, is of box-like configuration open at the top, with grates thereon, and with provisions for reducing obstacles to the flow of water into and out of the gutter, to achieve a balanced flow of water at reduced turbulence.

The principal object of the invention is to provide a gutter system for swimming pools that produces minimum water turbulence.

A further object of the invention is to provide a gutter system for swimming pools that is useful with swimming pools of varied size and shape.

A further object of the invention is to provide a gutter system for swimming pools which is of sturdy construction and requires a minimum of maintenance.

A further object of the invention is to provide a gutter system for swimming pools wherein a balanced flow of dirty water out of and clean water into the pool is obtained.

A further object of the invention is to provide a gutter system for swimming pools wherein a considerable reduction of mineral deposits on the sides of the swimming pool is obtained.

A further object of the invention is to provide a gutter system for swimming pools, wherein material savings can be achieved.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

Figure 1:
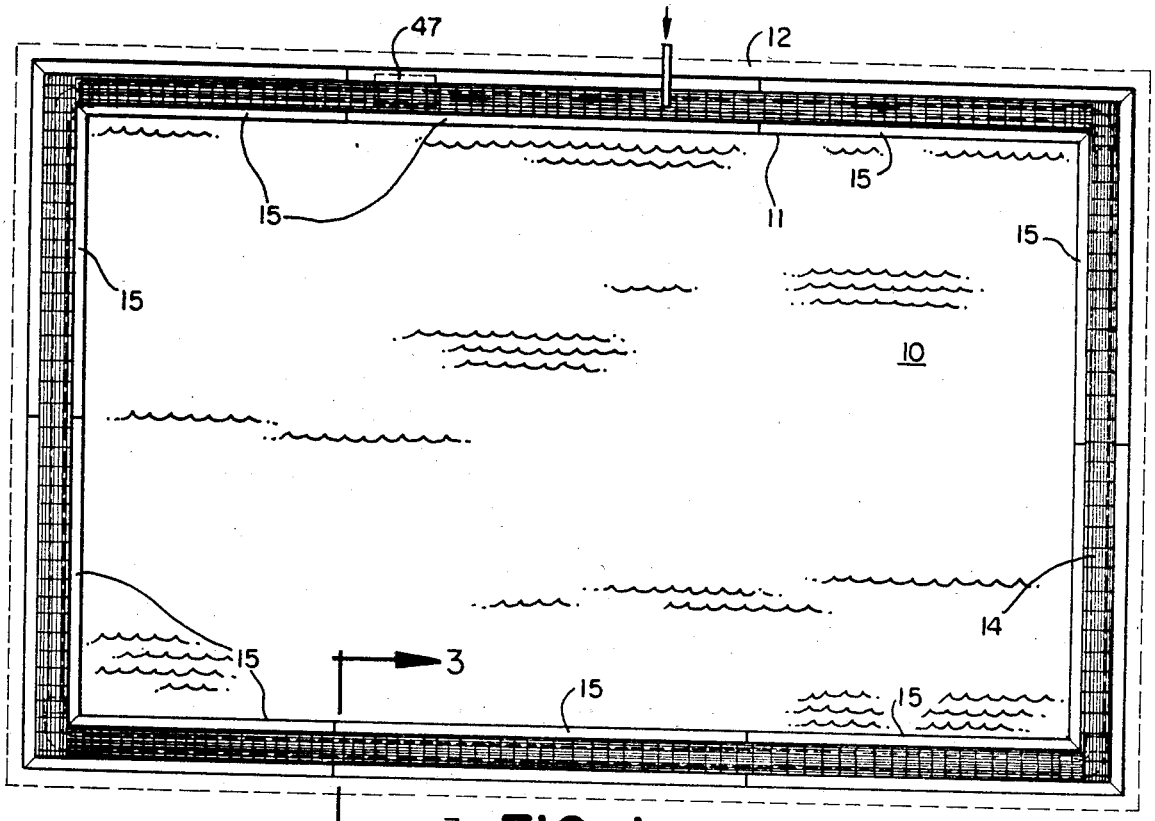
FIG. 1 is a top plan view of a swimming pool with the gutter system of the invention installed therein.
Figure 5:
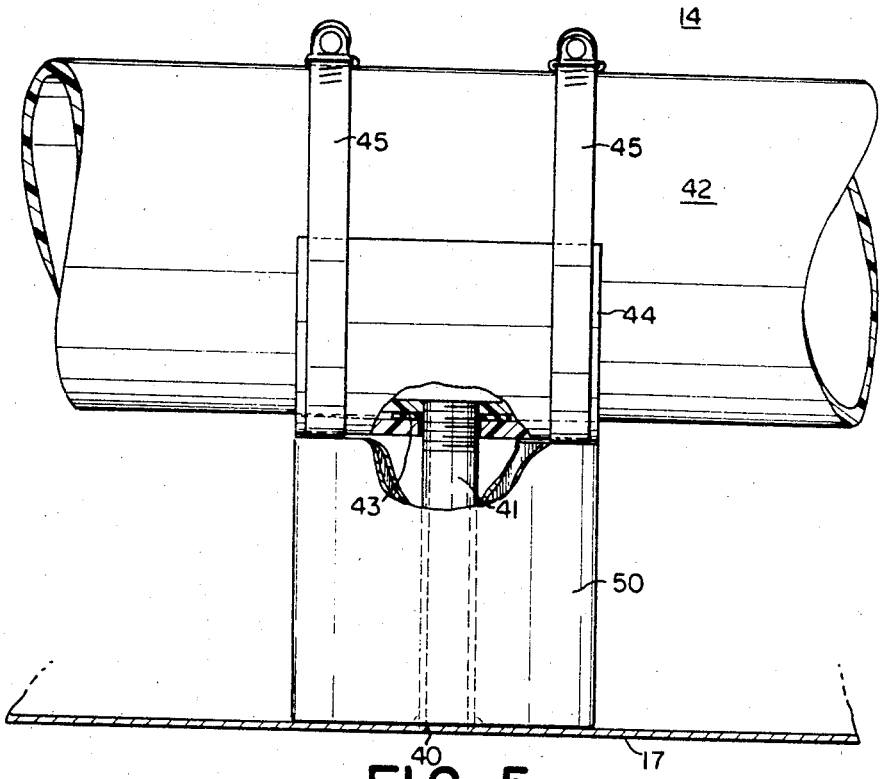
FIG. 5 is a sectional view taken approximately on the line 5—5 of FIG. 3.
Figure 2:
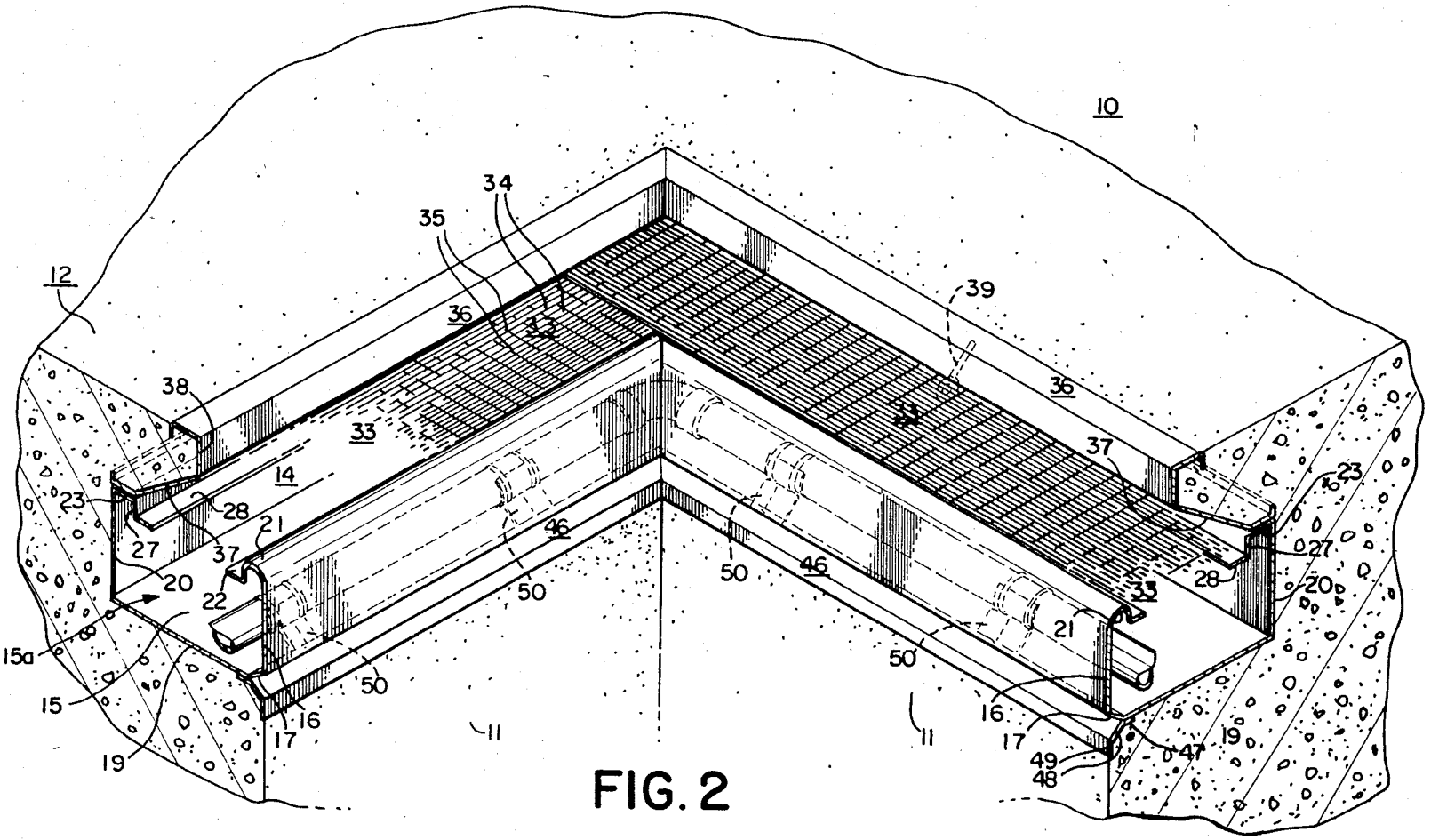
FIG. 2 is a perspective view of a portion of the gutter system of FIG. 1.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings and FIGS. 1 to 5, inclusive, a preferred embodiment of the gutter system of my invention is illustrated therein as installed on a concrete pool 10 of well known type. The pool 10 includes vertical walls 11 and a perimeter deck 12. A gutter system 14 is provided which extends around the perimeter of the pool 10 in a perimeteral groove at the intersection of the wall 11 and deck 12. The gutter system is formed of a plurality of sections 15, which may be of a length of eight feet and which are preferably joined together by welding. Each section 15 is of box-like configuration, open at the top, with a vertical front wall 16 facing towards the pool interior, an inclined wall 17 connected to the front wall 16, and a horizontal bottom wall 19 connected thereto, and to a vertical rear wall 20. The front wall 16 has a semicircular hand grip 21 with a small horizontal lip 22 extending towards the exterior of the pool 10. The rear wall 20 has a horizontal wall 23 extending towards the interior of pool 10, with a bracket 24 fastened thereto by bolts 25. The bracket 24 includes a wall 26 extending along and in contact with wall 23, a vertical wall 27 extending downwardly from wall 26, and a small horizontal lip 28 extending from wall 27 towards the interior of pool 10. The gutter sections can be fabricated of any desired material, with stainless steel being preferred. Covers or grates 33 are provided which are carried on and between the lips 22 and 28. The grates 33 have separated ribs 34, which extend along the perimeter of the pool 10 and spaced ribs 35 perpendicular thereto, retaining the grates together and which permits water to flow into the interiors 15*a* of the gutter sections 15. The grates 33 can be fabricated of any desired material, polyethylene plastic and stainless steel being preferred materials.

The horizontal wall 23 also has a splash back 36 fastened thereto by the bolts 25, with a forwardly inclined wall 37 extending over the grates 33, and a downturned U-shaped piece 38, the splash back 36 is also engaged with the deck 12 of the pool. If desired, anchors 39 can be provided for attachment of ropes (not shown) to define pool lanes (not shown) or other boundaries (not shown).

The inclined walls 17 have openings 40 therethrough, at spaced intervals therealong, with the preferred spacing being on four foot centers and with the length of section 15 being eight feet.

Injection nipples 41 are provided which are welded into the openings 40 and extend perpendicularly and rearwardly from the inclined walls 17 at an approximate angle of 45° to the bottom walls 19. The injection nipples 41 are engaged with a clean water return or header pipe 42 which extends around the perimeter of the pool 10, and is connected to a source of filtered clean water to be returned to the pool. The injection nipples 41 have O-rings or washers 43 thereon which extend between saddle fittings 44 and header pipe 42, with the saddle fittings 44 retained thereon by screw type clamps 45 of well known type. The bottom walls 19 have skirts 46 fastened thereto each of which includes a horizontal lip 47, an inclined wall 48 of opposite inclination to wall 17 and a vertical lip 49 attached to wall 48, which is in line with front wall 16. The skirts 46 are engaged with the walls 11 of the pool 10, the result being that water injected into the pool from nipples 41 is injected above the skirts 46 and therefore away from the walls 11 reducing the likelihood of mineral deposits on the walls 11 and any interference with the walls 11 which could cause turbulence.

To achieve a "fast pool", or one with little or no turbulence, it is necessary to absorb the waves created by the swimmer. The absorption occurs by the overflow into the gutter section. The overflowing water is under no pressure, and flows by gravity around the gutter perimeter until it reaches the converter 47 where it is removed and then pumped through a filter or series of filters (not shown), a heater (not shown) if desired, and then returned through the header pipe 42.

The large number of round injections nipples 41 in the gutter would significantly increase resistance to gravity water flow, and in a pool of 75 by 175 feet, there can be as many as one hundred twenty five nipples 41.

Figure 4:
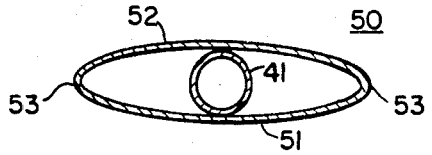
FIG. 4 is a sectional view taken approximately on the line 4—4 of FIG. 3.
Figure 3:
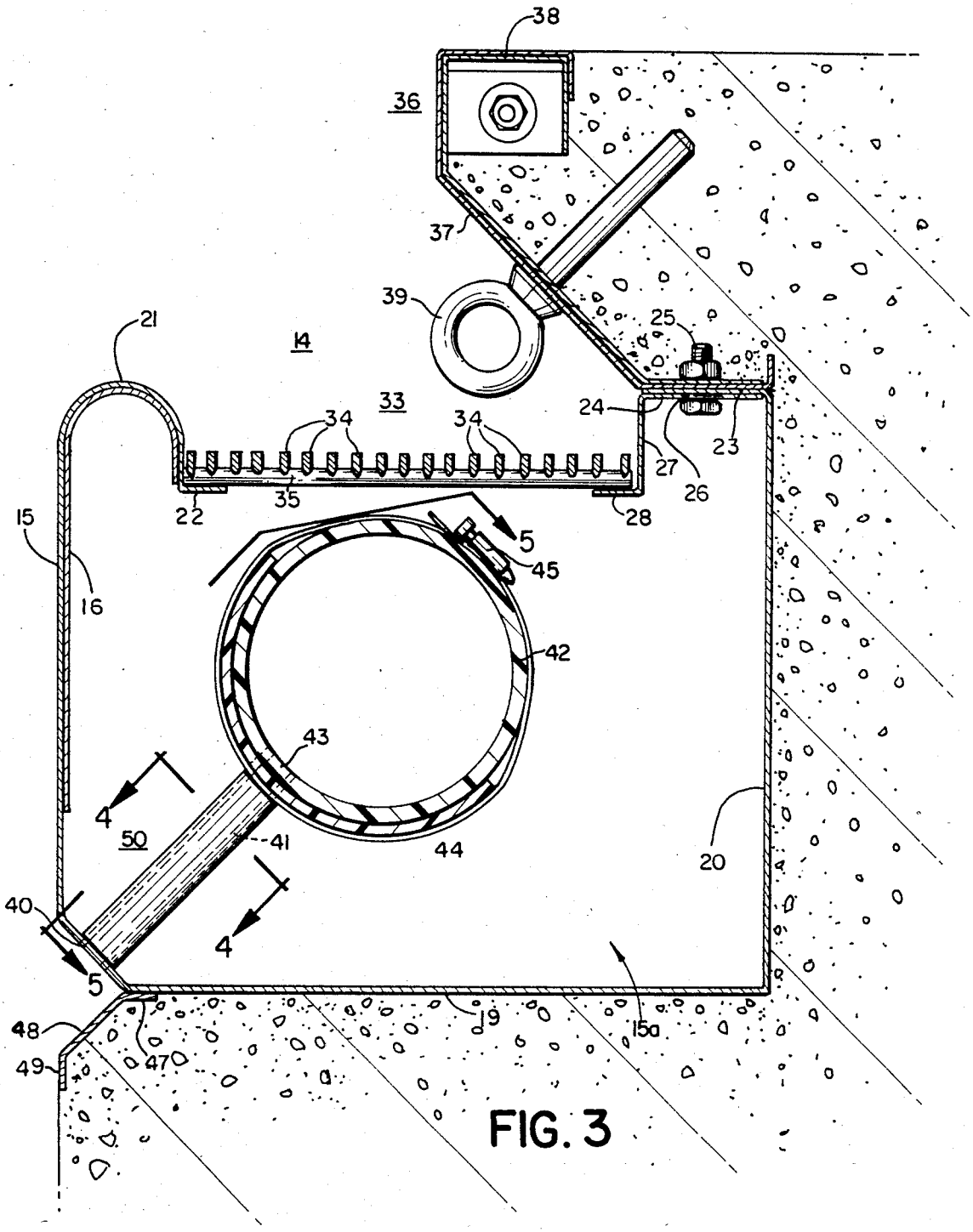
FIG. 3 is a vertical sectional view taken approximately on the line 3—3 of FIG. 1.

Each injection nipple 41 is provided with an elliptically shaped shield 50 which, as seen in FIG. 4, includes opposite side walls 51 and 52, which extend on either side of the nipple 41 and meet at points 53 where they are fastened together, and therefore present minimum resistance to the gravity flow of water in the gutter sections 15. Experiments have shown that the effect of the shields 50 is to reduce the drag and therefore the flow losses that would be associated with round injection nipples 41.

It should be noted that the drag coefficient for a circular cylinder is 1.2. For an elliptic cylinder of length/width=4, drag coefficient=0.32, and for length/width=8, drag coefficient=0.29. (Ref. V. L. Streeter, *Fluid Mechanics*, 5th Edition, McGraw-Hill, New York, 1971, p. 273).

Therefore a significant reduction in drag should result from the use of the shields 50.

To ascertain the expected water flow in a gutter conduit without obstructions, and to obtain the water height for flow at expected capacity gutter flow, calculations were made to determine the expected height. A Sylvan FC-800 gutter was selected, which is available from Sylvan Pools, Inc., Easton Road, Doylestown, Pa. 18901.

The gutter flow calculations were made using the formulas of open channel hydraulics (Streeter, pp. 276–78). In particular, the Chezy formula, $V=\sqrt{2gRS/f}$, and the Manning formula, $V=1.49R^{\frac{2}{3}}S^{\frac{1}{2}}/n$ were used. If we take the approximate dimensions from the FC-800 gutter, then the wetted perimeter is approximately $p=2\times 8''+11''+4.5\pi=41.1''$. The area of the gutter when full is $A=8\times 11-\pi(4.5)^2/4=72.1$ in$^2$. The hydraulic radius $R=A/p=1.75''=0.146$ ft. Assume the slope of the water surface is 1 inch in 75 ft. $S=(1/12)/75=0.00111$. Take $f=0.01$. Then $V=\sqrt{2\times 32.2\times 0.146\times 0.00111/0.01}=1.02$ ft/sec. The volumetric discharge $Q=V\times A=1.02$ ft/sec$\times$72.1 in$^2$/144 in$^2$/ft$^2\times$60 sec/min$\times$7.5 gal/ft$^3$=230 gal/min for a 1"/75 ft slope for each side. For a 3"/75 ft slope of water surface, $Q=230$ gal/min$\times\sqrt{3}=398$ gal/min per side. To drain both sides of the pool, gutter capacity is $398\times 2=796$ gal/min. Thus to drain 800 gal/min requires a little more that 3"(3.025" exactly) height difference in the water surface in the gutter, according to the Chezy formula.

The Manning formula gives $V=1.49\ R^{\frac{2}{3}}S^{\frac{1}{2}}/n$ where n is Manning's friction factor, also taken as 0.01. Using R=0.146 ft, S=0.00111 (1"/75'), V=1.38 ft/sec. Then the discharge $Q=V\times A=310$ gal/min per side for 1"/75' slope. To obtain 400 gal/min per side requires only 1.66"/75' slope.

An injection nipple length of 4 inches was selected as described below and calculations were made with and without the shields 50, for nipples of ⅜ and ½ inches nominal diameter. For a full gutter of the Sylvan FC-800 type, using the formulas previously discussed, and with the selected value of 0.146 feet for the hydraulic radius and Q=400 gal/minute for each side of the pool, the velocity V=1.78 ft/second. The drag for each injection nipple is $D=\frac{1}{2}\rho V^2 A_N \times C_D$ where $A_N$=2.748 inches$^2$ for a ⅜ inch diameter nipple and $A_N$=3.28 inches$^2$ for a ½ inch diameter nipple where the length is 4 inches. The drag D for a ⅜ inch diameter nipple=0.0702 lbs. and for a ½ inch diameter nipple=0.0838 lbs. The shear stress on the gutter walls=$\tau_W=\frac{1}{8}$ f$\rho$ V$^2$, where f=0.017 for $\epsilon$ (roughness factor)=0.001 and $Re=2\times10^5$ so that $\tau_W$=0.01303 lb/ft$^2$. The frictional force=$X_F=\tau_w$ pL where L=length of sections, p=wetted perimeter, so that the total frictional force $X_F$=0.2487 lb. for a ⅜ inch diameter nipple per four foot section; and $X_F$=0.4408 lb. per eight foot section for a ½ inch diameter nipple. The nipple fraction of the drag being 28% for a ⅜ inch diameter nipple and 19% for a ½ inch diameter nipple. Therefore, for a ⅜ inch diameter nipple the pressure drop per four foot section=$\Delta P=X_F/A$=0.2487/0.5007=0.4967 lb/ft$^2$. The ΔP on 38 sections=18.87 lb/ft$^2$=0.131 psi=$\rho gh$=1.935×32.2×$h$ where h=0.303 ft.=(3.63 inches on 152 feet) or 1.79 inches on a 75 foot reference length of gutter. This figure of 1.79 inches is the difference in height due to the frictional forces required to drain the stated flow rate of 400 gallons/minute from the gutter.

If we then calculate the drag when the injection nipples 41 are equipped with the shields 50, and calculate the differences in height of water, it can be ascertained if the shields reduce the drag sufficiently to affect the height and therefore improve the flow and efficiency of the pool. For the ⅜ inch diameter nipple 41 the length of the shields 50 over the width $l/w$=4, $C_D$=0.32, ½ $\tau$ V$^2$A=0.0585. The drag D then equals $D=C_D\times\frac{1}{2}\tau V^2 A$=0.0585×0.32=0.01872/injection nipple. The total frictional force $X_F$=0.1785+0.01872=0.1972 lb/4 foot section, then $\Delta P=X_F/A$=0.1972/0.5007 per four foot section×38 sections=14.97 lb/ft$^2$,=$\tau gh$=1.935×32.2×$h$; h=0.240 foot or 2.88 inches on 152 foot, or for a 75 foot section,=1.42 inches which is the height required to drain a 75 foot section of gutter with shields 50 on the injection nipples 41. The difference being 1.79 without the shields and 1.42 with them which discloses the improvement obtained by addition of shields 50.

In order to provide the gutter system 14 with a smooth return of clean water into the pool, it was determined that the flow of water must be impeded as little as possible. Accordingly, the interiors of the injection nipples 41 are of smooth bore and without any flow restrictions. The length of the nipple 41 is approximately 10 times the diameter of the nipple 41. In order to determine the shape, decay and entrainment due to a turbulent jet, reference is made to H. Schlicting, *Boundary Layer Theory,* 7th Edition, McGraw Hill, 1979, at pages 748f. To determine the meeting points of the jets from adjacent nipples when the flow is entrained, pressure and velocity were selected from the following table:

| p (psig) | $V_o$ (ft/sec) |
|---|---|
| 10 | 29.5 |
| 15 | 36.1 |
| 20 | 41.7 |
| 25 | 46.6 |
| 30 | 51.0 |

The centerline velocity decays according to $V(z)/V_o$=0.205/$z$(ft). Then $V(z)=1.91\sqrt{\Delta p(\text{psig})}/z$ ft. For V to fall to 5% of the original value, $V(z)/V_o$=0.05, z=4.1 ft. At 15 psig, $V(4.1)$=1.8 ft/sec. For V to fall to 1% of its original value, $V(z)/V_o$=0.01, z=20.5 ft. Here $V(20.5)$=0.36 ft/sec. The half-width of the jet $b_{\frac{1}{2}}$=0.0848 z. Now the full width of the jet is about 4×$b_{\frac{1}{2}}$=0.34 z. If z=5 ft, the jet width=1.7 ft. For two adjacent jets to merge, the width must be about 3 ft (so that edges of adjacent jets just meet), so z=8.82 ft.

For a 4 inch long injection nipple of 0.4687 inches diameter, and assuming a square entrance $V_o=9.49\sqrt{\Delta p}$ psi and $Q(gpm)=5.115\sqrt{\Delta p}$ psi. For a total of 800 gpm through 76 jets we want 10.53 gal/min for each jet. This would require a pressure of 4.24 psi. We calculate the pressure loss through the water supply or header pipe 42 of four inches diameter, and with the pressure drop along each parallel water path of 152 foot, which carries 400 gallons per minute it is 5.39 psi. If we assume a linear decrease of flow rate with distance then the pressure loss is 2.81 psi. Therefore, to provide a resultant pressure of at least 10 psi we require a pump which has a 7.5 horsepower motor.

It should be noted that, because the gutter drains faster than conventional prior art gutters, that a smaller cross section is required which results in considerable material savings.

Observation of a pool with the gutter system 14 installed as described above, indicated that the injection nipples 41 direct the water away from the walls, and that no noticeable turbulence exists from water injection or from skimming dirty water, and mineral deposits on pool walls are eliminated.

It is therefore apparent that apparatus has been provided with which the objects of the invention are attained.

I claim:

1. An overflow recirculating gutter system for use around the perimeter of a swimming pool having vertical side walls and a deck, for skimming the surface water of the pool and returning clean water to the pool which comprises a plurality of open box-like gutter sections secured together in end to end relation and carried in a perimeter groove between said side walls and said deck, each section having a front wall facing the interior of said pool, an inclined wall attached to said front wall having spaced openings therethrough, a bottom wall attached to said inclined wall, and a rear wall attached to said bottom wall, skirt means fastened and extending along said pool side of said bottom wall, said skirt means including an inclined wall resulting in that water injected into the pool from injecting nipples is injected above the skirt and away from the vertical walls of the pool, a converter in communication with said gutter sections to carry away skimmed water, water supply means carried within said gutter sections for supplying clean water which includes a header pipe and fittings extending around the perimeter of the pool, a plurality of injection nipples in communication with said header pipe and engaged with said openings in said first mentioned inclined wall, and drag reducing means in said gutter and engaged with the exteriors of said injection nipples, said drag reducing means including side walls which extend on either side of said injection nipples.

2. A gutter system as defined in claim 1 in which said drag reducing means is a plurality of elliptical shields engaged with and enclosing said injection nipples.

3. A gutter system as defined in claim 1 in which said skirt means includes a horizontal wall fastened to said pool side of said bottom wall, and an inclined wall attached to the pool side of said bottom wall extending forwardly and downwardly towards the interior of the pool, of opposite angular inclination to said first mentioned inclined wall, and a vertical wall fastened to said inclined wall and in line with said vertical wall of said pool.

4. A gutter system as defined in claim 1 in which said injection nipples are of smooth bore.

5. A gutter system as defined in claim 1 in which the length of each injection nipple is ten times the diameter of the nipple.

6. A gutter system as defined in claim 1 in which said gutter sections are provided with grates which permit skimmed water to pass into said gutter sections.

7. A gutter system as defined in claim 1 in which said fittings include detachable saddles connecting said header pipe and said injection nipples, and clamp means retaining said saddles to said pipe.

* * * * *

UNITED STATES PATENT AND TRADEMARK OFFICE

CERTIFICATE OF CORRECTION

PATENT NO. : 4,593,421

DATED : June 10, 1986

INVENTOR(S) : IRA M. COHEN

It is certified that error appears in the above-identified patent and that said Letters Patent is hereby corrected as shown below:

Column 5,

Line 41, after "1/2", "ϖ" should be -ρ-;

Line 43, before "$V^2A$", "ϖ" should be -ρ-;

Line 46, after "$lb/ft^2$,=", "ϖ" should be -ρ-.

Signed and Sealed this

*Nineteenth* Day of *August 1986*

[SEAL]

*Attest:*

DONALD J. QUIGG

*Attesting Officer*

*Commissioner of Patents and Trademarks*